US007398776B2

(12) United States Patent
Casas Salva

(10) Patent No.: US 7,398,776 B2
(45) Date of Patent: Jul. 15, 2008

(54) COMPRESSED GAS OPERATED PISTOL

(75) Inventor: Francesc Casas Salva, Barcelona (ES)

(73) Assignee: Industrials el Gamo, S.A., Barcelona (ES)

( * ) Notice: Subject to any disclaimer, the term of this patent is extended or adjusted under 35 U.S.C. 154(b) by 78 days.

(21) Appl. No.: 10/719,013

(22) Filed: Nov. 24, 2003

(65) Prior Publication Data

US 2004/0200466 A1 Oct. 14, 2004

(30) Foreign Application Priority Data

Nov. 25, 2002 (ES) ..... 200202704

(51) Int. Cl.
*F41B 11/00* (2006.01)

(52) U.S. Cl. ..... 124/74

(58) Field of Classification Search ..... 124/71–77; 42/70.11

See application file for complete search history.

(56) References Cited

U.S. PATENT DOCUMENTS

| | | | | | |
|---|---|---|---|---|---|
| 2,817,328 | A * | 12/1957 | Gale | 124/74 |
| 3,204,625 | A * | 9/1965 | Shepherd | 124/74 |
| 3,882,622 | A * | 5/1975 | Perlotto | 42/70.11 |
| 5,509,399 | A * | 4/1996 | Poor | 124/76 |
| 5,711,286 | A * | 1/1998 | Petrosyan et al. | 124/73 |
| 5,906,191 | A * | 5/1999 | Wonisch et al. | 124/31 |
| 6,065,460 | A * | 5/2000 | Lotuaco, III | 124/72 |
| 6,112,734 | A * | 9/2000 | Kunimoto | 124/73 |
| 6,138,656 | A * | 10/2000 | Rice et al. | 124/73 |
| 6,158,424 | A * | 12/2000 | Kunimoto | 124/73 |
| 6,389,728 | B1 * | 5/2002 | Lundy | 42/70.11 |
| 6,497,229 | B1 * | 12/2002 | Maeda | 124/76 |
| 6,578,565 | B2 * | 6/2003 | Casas Salva | 124/73 |
| 6,601,780 | B1 * | 8/2003 | Sheng | 239/337 |
| 6,708,685 | B2 * | 3/2004 | Masse | 124/75 |
| 6,739,323 | B2 * | 5/2004 | Tippmann, Jr. | 124/51.1 |
| 6,763,822 | B1 * | 7/2004 | Styles | 124/77 |
| 2002/0139362 | A1 * | 10/2002 | Shipachev et al. | 124/74 |
| 2003/0047174 | A1 * | 3/2003 | Tiberius et al. | 124/74 |

* cited by examiner

*Primary Examiner*—Troy Chambers
(74) *Attorney, Agent, or Firm*—Ked & Associates, LLP

(57) ABSTRACT

An improved compressed gas operated pistol is provided which maximizes use of compressed gas energy by minimizing loss of energy from the chamber into the magazine. An aft end portion of the barrel of the pistol is formed extended as a thin wall portion. When the trigger of the pistol is actuated, this thin wall portion of the barrel is fitted tightly into the chamber, confining the next pellet to be fired within the cylindrical walls of the thin wall portion and the rear surface of the chamber, and sealing off the chamber from the magazine. In this manner, the full impact of the energy provided for firing by the compressed gas cylinder to the chamber is imparted on the pellet.

26 Claims, 5 Drawing Sheets

COMPRESSED GAS OPERATED PISTOL

BACKGROUND OF THE INVENTION

1. Field of the Invention

This invention concerns a compressed gas operated pistol, and, more specifically, a compressed gas operated pistol that comprises a sealing element to isolate the chamber with respect to the opening of the ammunition magazine at the time of firing.

2. Background of the Related Art

Conventional art compressed gas operated pistols essentially comprise a support casing that defines a barrel zone, a trigger zone and a stock zone. The barrel zone contains a barrel with the rear end facing a chamber. In the trigger zone, there is a trigger connected to a hammer operating mechanism. In the stock zone, there is an ammunition magazine arranged to insert a pellet into said chamber through an opening prior to each shot. A pressurised gas cylinder with a valve chamber which, in turn, is connected to said chamber via a valve element pushed by an elastic means towards a closed position. Said valve element can be instantly moved to an open position by impact from said hammer.

One inconvenience presented by these conventional art pistols is that the magazine has said opening, through which the pellets enter the chamber, formed by an opening in an interior chamber wall, and this causes part of the pressurised gas supplied by the valve element to escape at the moment of firing, through said opening towards the interior of the magazine and which is not employed in impulsion for the pellet. In other words, there is a loss of the energy supplied by the gas pressure leading to a reduction in pellet range.

SUMMARY OF THE INVENTION

The objective of this invention is to provide a compressed gas operated pistol that comprises a sealing element operated by the trigger to isolate the chamber with respect to the ammunition magazine opening at the time of firing.

This objective is reached, in accordance with this invention, by providing a compressed gas operated pistol of the type described above, in which said barrel is able to move and is guided linearly to cause a movement of a rocker in an axial direction. This moving barrel is linked to said trigger and an elastic element is arranged to push the trigger and barrel assembly forwards to an inactive position. Said link between the trigger and barrel is such that, when the trigger is pressed against the force of said elastic element, the trigger moves the barrel backwards, thus operating a sealing element arranged so that it isolates the chamber with respect to the ammunition magazine. Preferably, said sealing element comprises a thin cylindrical wall directly arranged in said rear end of the barrel, defining an interior surface that is a continuation of the barrel bore surface, an exterior surface that can be adjusted inside the interior surface of the chamber, and a final perimeter edge. This thin cylindrical wall is arranged in such a manner that, when the barrel is moved backwards by the trigger, the thin cylindrical wall fits tightly into the chamber, collecting on its passage along the path said pellet, which is located in the chamber, until said final perimeter edge is supported against the rear surface of the chamber, thus sealing the entrance for the compressed gas. In this position, the thin cylindrical wall arranged in the rear end of the barrel takes over the functions of the chamber and, at the same time, the exterior surface of the thin cylindrical wall closes off the magazine opening to guarantee that the gas released during firing passes into the barrel bore and all its energy is fully employed in driving the pellet forward.

As is usual, the ammunition magazine comprises an ammunition store forming a column of several pellets. This store communicates with the chamber through said opening and a spring-loaded ammunition push mechanism is arranged to push said column of pellets towards the chamber, with the last (uppermost) pellet in the column remaining in the chamber.

In order to prevent the final perimeter edge of the thin cylindrical wall, upon penetrating the chamber, from trapping the penultimate pellet against the rear wall of the chamber, which would make firing impossible, this invention provides a means to prevent this, comprising a trap that is jointed with respect to a shaft and arranged in said opening between said ammunition store and the chamber. In the non-operational position, this trap is pushed upwards by the penultimate pellet in the column by virtue of the magazine spring force, and is set with one end arranged between said penultimate pellet and the last pellet, which is now located in the chamber. When the thin cylindrical wall of the rear end of the barrel enters the chamber, the final perimeter edge pushes said trap downwards, which drags along the penultimate pellet and with it, the rest of the column against the force of said magazine spring, leaving the last pellet free in the chamber so that it can be collected inside the thin cylindrical wall. For this reason, the trap has a suitable transverse section profile. As is usual, the outside diameter of the pellet is slightly less than the inside diameter of the barrel bore to ensure that the pellet does not fall out of the barrel muzzle and to prevent loss of pressure between the pellet and the barrel.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

These and other characteristics and advantages are better understood from the following detailed description of a constructional example, with reference to the included drawings, in which.

DETAILED DESCRIPTION OF PREFERRED EMBODIMENTS

Figure 1:
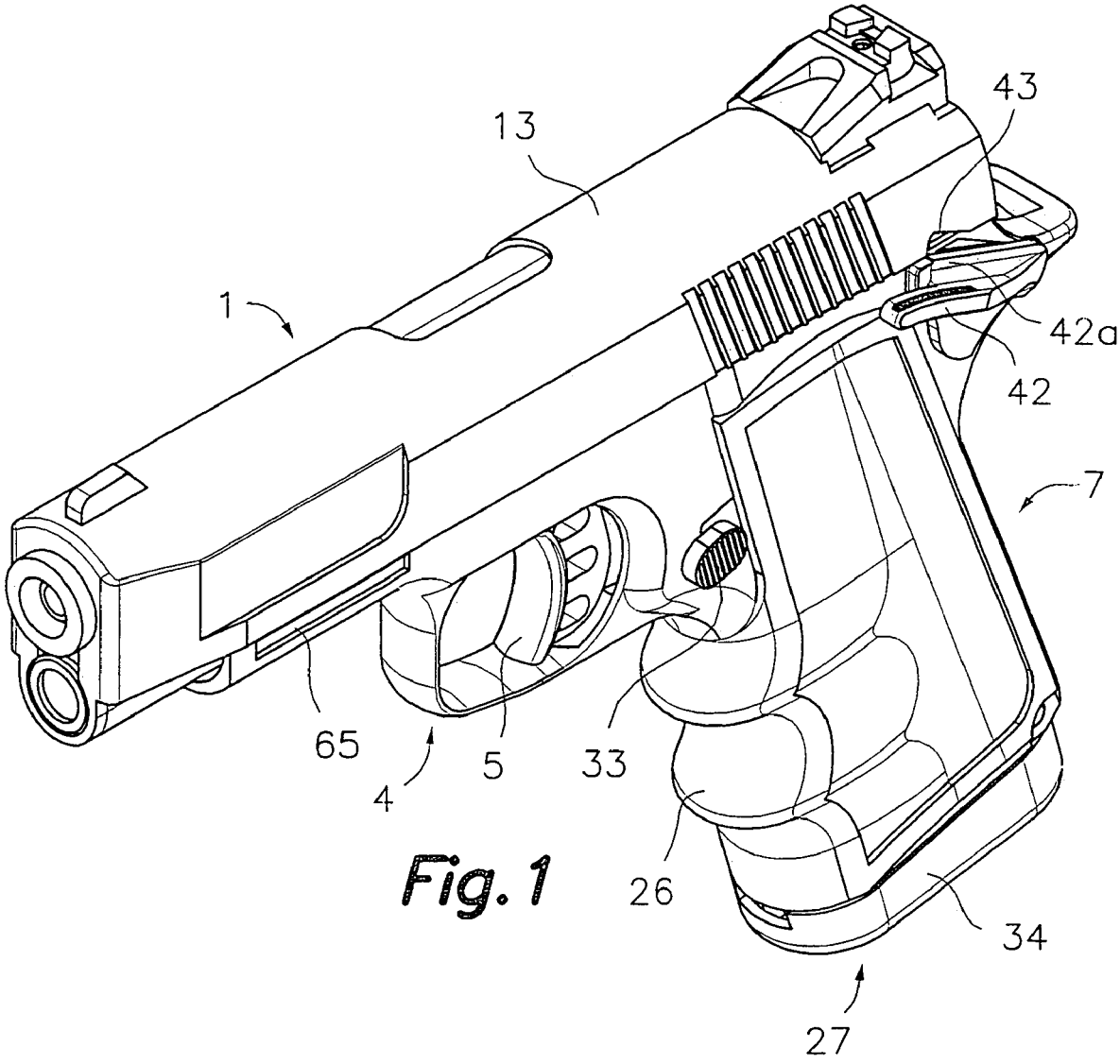
FIG. 1 is a perspective view of the compressed gas operated pistol in accordance with this invention.
Figure 2:
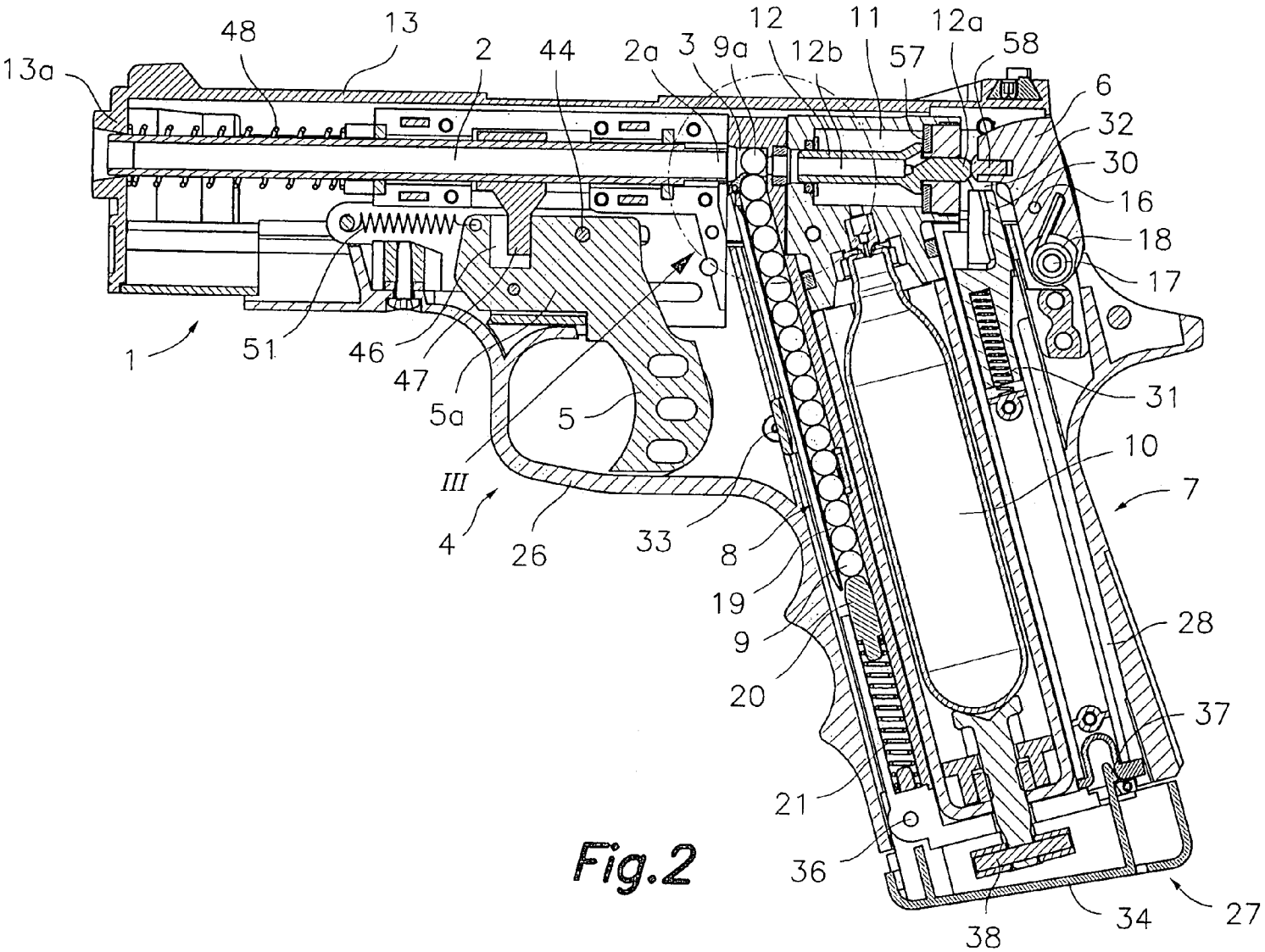
FIG. 2 is a longitudinal sectional view of the pistol shown in FIG. 1.

First referring to FIGS. 1 and 2, the compressed gas operated pistol of this invention comprises a support casing 26, which defines a barrel zone 1, a trigger zone 4, and a stock zone 7. In the barrel zone 1, there is a barrel 2, with rear end 2*a* facing a chamber 3. In the trigger zone 4, there is a trigger 5 connected to an operating mechanism for a hammer 6. In the stock zone 7, there is an ammunition magazine 8, arranged to insert a pellet 9 in said chamber 3, prior to each shot, and a pressurised gas cylinder 10 communicating with a valve chamber 11. This valve chamber 11 is in turn, connected to said chamber 3 by means of a valve element 12, which is pushed by elastic means (not shown) towards a closed position and which can be instantly moved to an open position by an impact from said hammer 6.

Figure 8:
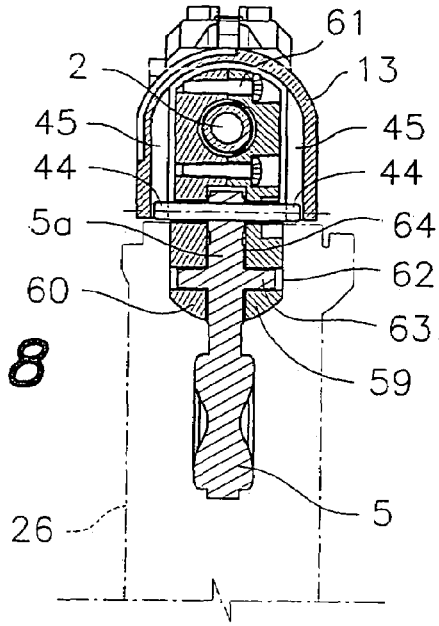
FIG. 8 is a transverse sectional view taken at line IX-IX of FIG. 5.

As shown in FIG. 2, and in accordance with this invention, barrel 2 is able to move and is linearly guided in order to carry out a rocking movement in an axial direction. Barrel 2 is also linked to said trigger 5 by a catch 47, which is firmly fixed to the barrel 2 and inserted into a cavity 46 in a trigger piece 5*a*, of which trigger 5 forms an integral part. Said trigger piece 5*a* is installed in said trigger zone 4 so that it is able to slide guided linearly in a direction parallel to the barrel 2 axis, which is described in more detail with reference to FIGS. 5 and 8, and an elastic element 51, such as an elastic traction spring, is arranged to push the trigger 5 and barrel 2 assembly forwards to a resting position. When trigger 5 is pressed against the force of spring 51, cavity 46 drags the barrel 2 backwards, operating sealing elements 2*b*, 2*c* in order to isolate the chamber 3 with respect to the ammunition magazine 8.

Figure 3:
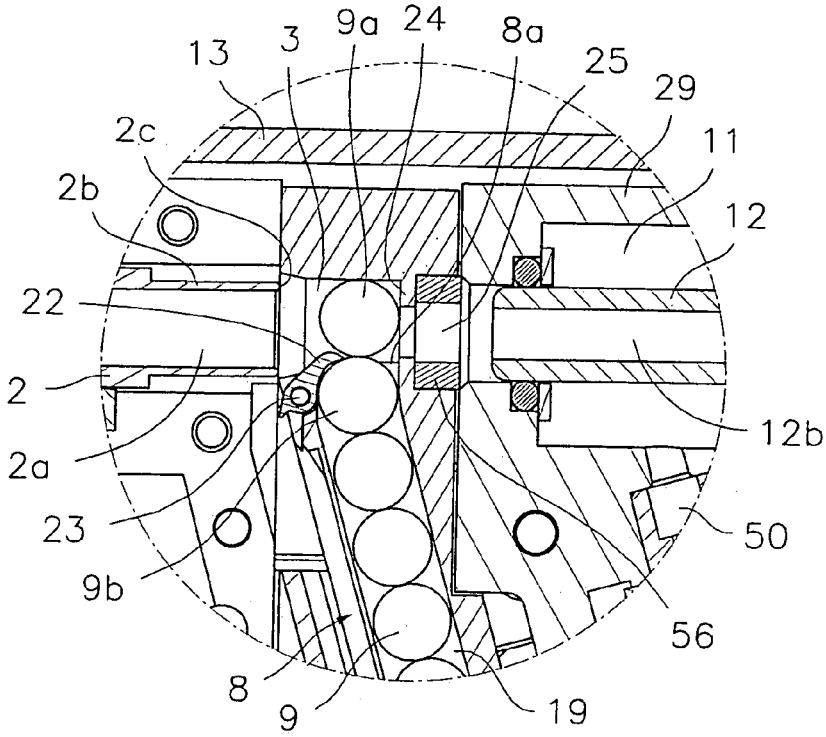
FIG. 3 is an enlarged view of area III of FIG. 2, showing a part of the mechanism in a resting position.
Figure 4:
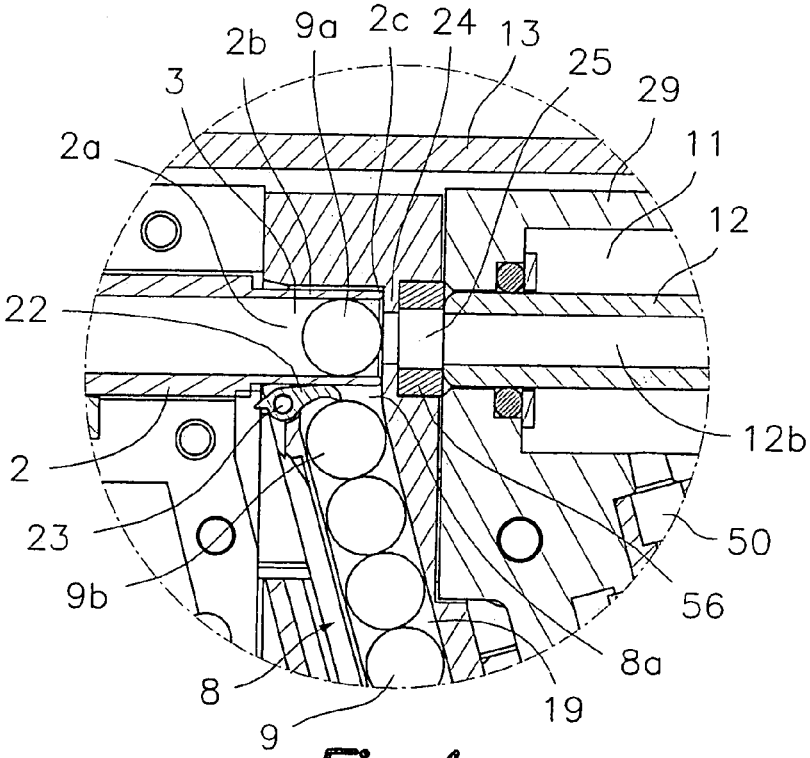
FIG. 4 is an enlarged view of area III of FIG. 2, showing a part of the mechanism is a firing position.

As shown in FIGS. 3 and 4, said sealing elements 2*b*, 2*c* comprise a thin cylindrical wall 2*b* that fits into said rear end 2*a* of barrel 2, preferably by the machining of the actual material of barrel 2. This thin cylindrical wall 2*b* defines an interior surface that is a continuation of the barrel bore surface, an exterior surface that can be adjusted to the interior surface of chamber 3, and a final perimeter edge 2*c*. FIG. 3 shows the barrel 2 in the resting position, in which the sealing elements 2*b*, 2*c* of the rear end 2*a* of barrel 2 face the chamber 3, which contains a pellet 9*a*. The thin cylindrical wall 2*b* is arranged so that, when the barrel 2 is moved backwards by the trigger 5 (see FIG. 4), the thin cylindrical wall 2*b* enters the chamber 3, collecting along the way said pellet 9*a*, which is located in the chamber 3, until said final perimeter edge 2*c* is supported against the rear surface 24 of the chamber 3, making sealed contact around the compressed gas entrance 25, while said exterior surface isolates the chamber 3 from an opening 8*a* in the ammunition magazine 8.

Typically, said ammunition magazine 8 comprises an ammunition store 19 for a column of pellets 9, where this store 19 communicates with said chamber 3 through said opening 8*a*. An ammunition push mechanism 20, operated by spring 21, is arranged to push said column of pellets 9 towards the chamber 3. In accordance with this invention, a trap 22 jointed with respect to a shaft 23 is arranged in said opening 8*a* between said ammunition store 19 and the chamber 3, so that it is pushed upwards by the penultimate pellet 9*b* in the column. In the resting position shown in FIG. 3, trap 22 is raised and with one end between the last and penultimate pellets, 9*a* and 9*b*, respectively. Trap 22 has a transverse section profile that is suitable for retaining the pellet 9*a* in the chamber 3 and to act as a cam when it is pushed by the thin cylindrical wall 2*b* of the rear end 2*a* of barrel 2. In the firing position shown in FIG. 4, the thin cylindrical wall 2*b*, dragged by the trigger 5, has penetrated inside the chamber 3 and the final perimeter edge 2*c* has pushed trap 22 downwards, which has dragged the penultimate pellet 9*b* and with it, the rest of the column of pellets 9 against the force of said spring 21 of the ammunition push mechanism 20, thus freeing pellet 9*a*, which has been inserted into the rear end 2*a* of the barrel 2, which now acts as the chamber 3, just as was described above.

Valve element 12 has been moved under the impact of the hammer 6, as will be described below, until it makes contact with a seal 56 at the opening of passageway 25. The valve element 12 is a conventional type and comprises an operating end 12*a* (see FIG. 2) which is struck by the hammer 6, and an axial passageway 12*b* with a front opening facing passageway 25 and one or more rear openings that are blocked off by a seal 57 when the valve element 12 is in the resting position and which opens in the valve chamber 11 when the valve element 12 is in the firing position.

The upper section of barrel zone 1 also comprises a sliding cover 13 linearly guided to make a rocking movement in a direction parallel to the barrel 2 axis. The rear end of said sliding cover 13 includes links 14, 16 with said hammer 6, which are described in more detail below with reference to FIGS. 6 and 7 and are linked to said trigger 5 so that when the trigger is pressed, it moves the sliding cover 13 backwards, thus performing the actions of cocking and firing the hammer 6 through the motion of said links 14, 16 in synch with said backwards movement of the barrel 2. A helicoidal compression spring 48 is arranged around the barrel 2 and compressed between the front interior end 13*a* of the sliding cover 13 and a surface of the support casing 26 or a body joined to this in order to push the sliding cover 13 forwards to the resting position.

Figure 5:
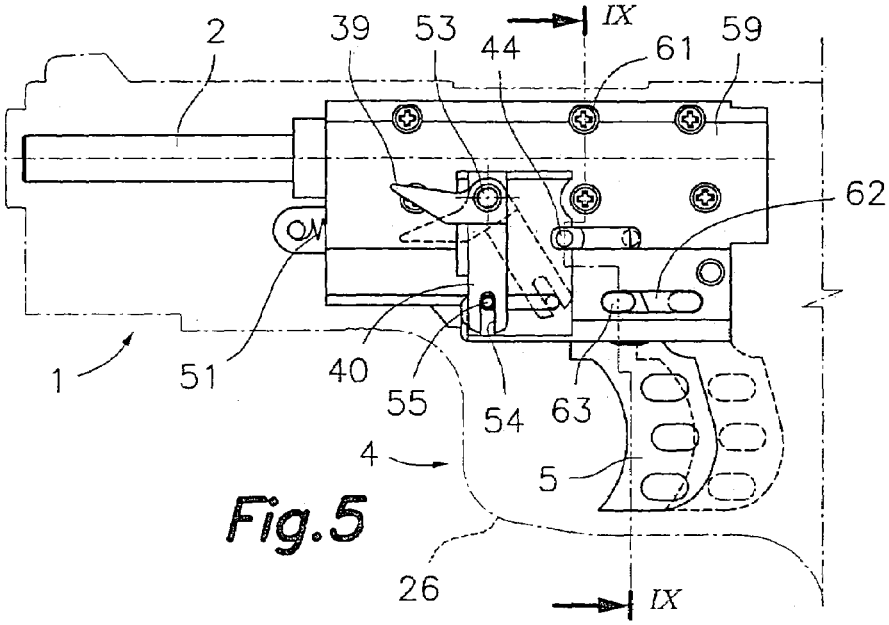
FIG. 5 is a side view of a portion of the mechanism, in which the casing outline is shown by the dotted and broken lines.
Figure 6:
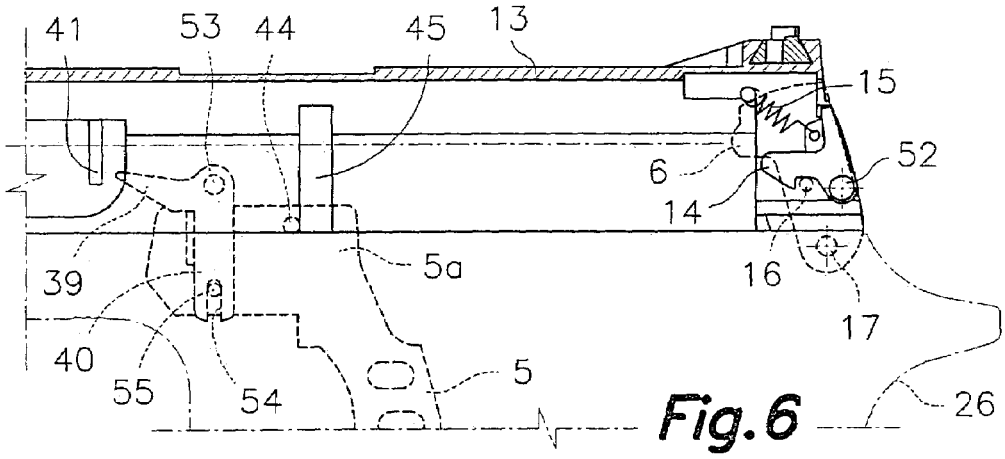
FIGS. 6 and 7 are longitudinal sectional views of the sliding cover in resting and firing positions, respectively, and in which a casing outline is shown in dotted lines, and other mechanism outlines are shown in broken lines.

FIGS. 5 and 6 show the installation of the trigger 5 in said trigger zone 4. A pair of pieces 59, 60 shown in FIG. 8, facing each other, and joined together by means of screws 61 and fixed in place with respect to the casing 26, define between them, a guide for barrel 2, a housing 64 for a trigger piece 5*a* that is an integral part of the trigger 5, and slots of guide 62, into which are inserted protuberances 63 which laterally extend over said trigger piece 5*a* so that the same is able to slide into said housing 64 linearly guided by the guide slots 62 in a direction parallel to the barrel 2 axis. The trigger piece 5*a* comprises drag snugs 44, preferably provided by the ends of a pin (FIG. 8), which extend laterally from the same and interfere with internal stops 45 of the sliding cover 13 in order to drag it. Just as described above in reference to FIG. 2, the trigger piece 5*a* includes a cavity 46, into which is inserted a catch 47 that is firmly attached to the barrel 2 in order to drag it. Between said catch 47 and wall contacts in said cavity 46, is free play to permit a delay in the beginning of barrel 2 movement with respect to the start of trigger 5 movement and to guarantee less barrel 2 movement when trigger 5 is pressed as when it is free.

FIG. 5 also shows an automatic safety catch 39 linked to trigger 5 so that said safety catch 39 interferes with a fixed stop 41 inside the sliding cover 13 when trigger 5 in is said resting position (FIG. 6), preventing any voluntary or involuntary movement of the sliding cover 13 independently of trigger 5 movement, which could produce firing. The catch 39 is separated from the path of said stop 41 by the trigger 5 when this is pressed (FIG. 7), allowing movement of the sliding cover 13 by the trigger 5. This automatic safety catch 39 is connected to the arm 40 installed on part 59 fixed to the casing 26 so that it is able to pivot with respect to axis 53. Said arm 40 incorporates a linear guide 54, along which snug 55 slides joined to the trigger 5 or trigger piece 5*a*, by which a backwards movement of trigger 5 produces a downwards movement of automatic safety catch 39 just as shown by the broken lines in FIGS. 5, 6 and 7.

Figure 7:
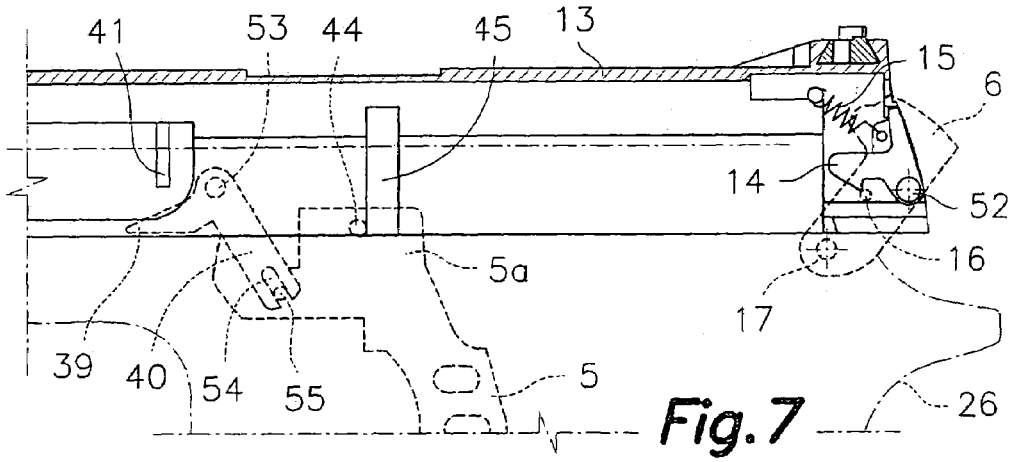

FIGS. 6 and 7 show said links 14, 16 of the sliding cover 13 with the hammer 6. A pawl 14 is articulated by a pin 52 loaded by a spring 15 and a protuberance 16, which extends laterally over the hammer 6. The hammer 6 is mounted on the rear section of casing 26 so that it can pivot with respect to shaft 17 and is pushed by a spring 18 (see FIG. 2) towards a position in which a stud 58 fixed at its distal end is in contact with the operating end 12*a* of the valve element 12. In the resting position shown in FIG. 6, the sliding cover 13 is in its front position, the hammer 6 is in its position of contact and said pawl 14 is coupled with said protuberance 16 of the hammer 6. When the sliding cover 13 is moved linearly backwards by the trigger 5, said pawl 14 drags along said protuberance 16 and causes the hammer 6 to pivot backwards against the force of said spring 18 until it reaches the firing position shown in FIG. 7, in which, in virtue of the curved path of protuberance 16, this escapes from the pawl 14 and spring 18 pushes the hammer 6 to cause said impact on said valve element 12. Just as was described above, this is produced in synch with the movement of the barrel 2 in order to isolate the chamber 3. When the trigger 5 is then freed, the sliding cover 13 returns to the resting position and forces the pawl 14 to exceed the protuberance 16, pivoting against the force of spring 15.

As shown in FIG. 1, the pistol comprises a voluntary safety element 42 mounted on the exterior of an upper section of the stock zone 7 so that it can be voluntarily pivoted between a locked position, in which a tooth 42*a* of said voluntary safety element 42 fits into a recess 43 in said sliding cover 13 and a free position in which said tooth 42*a* is not fitted into said recess 43. By immobilising the sliding cover 13, this voluntary safety element 42 prevents the operation of trigger 5 from producing firing of the pistol. Casing 26 of the pistol also includes longitudinal channels 65 on both lower sides of the barrel zone 1, which are adapted for accepting various accessories.

Figure 9:
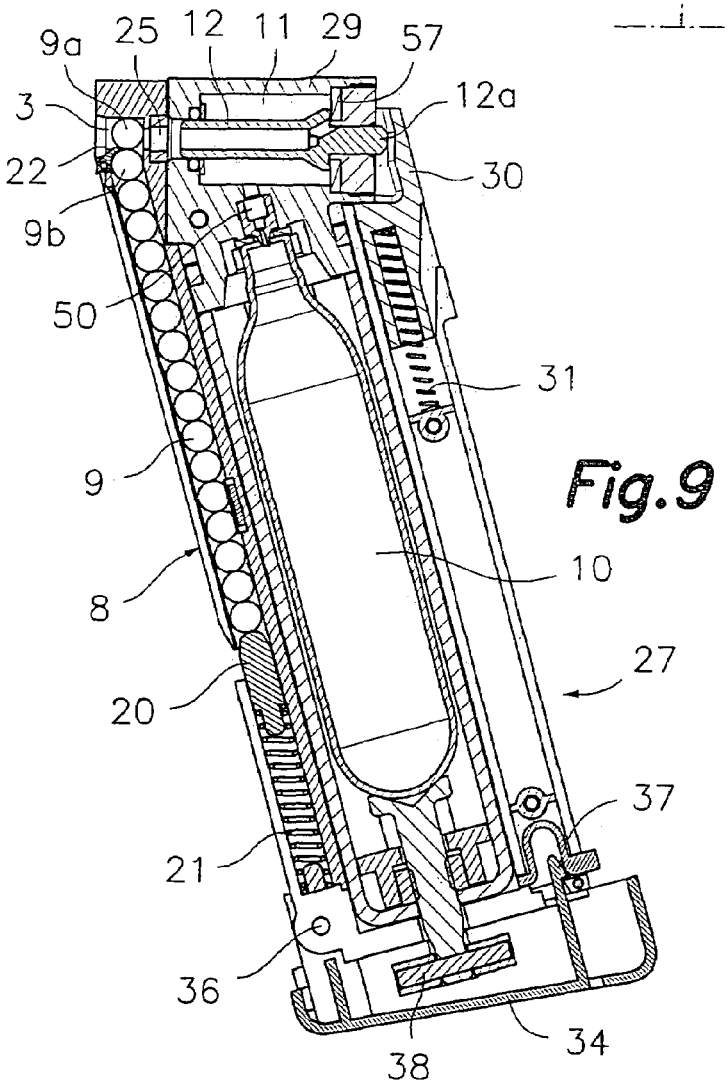
FIG. 9 is a transverse sectional view of the case, which includes the magazine and gas cylinder removed from the stock zone.

FIG. 9 shows a casing 27. The support casing 26 is hollow in the stock zone 7 (see FIG. 2) and is open at the lower end to receive said casing 27, which includes said ammunition magazine 8, together with the chamber 3; a cavity 28 for housing the pressurised gas cylinder 10, with a perforation needle 50 that perforates a gas exit in the pressurised gas cylinder 10; a valve body 29, which defines said valve chamber 11, and which holds said valve element 12; and a sliding protector 30 configured and arranged to cover said operating end 12*a* of the valve element 12 when said casing 27 is removed from the stock zone 7. This sliding protector 30 is pushed by a spring 31 towards a position of protection, as shown in FIG. 9, in which one end of the sliding protector 30 covers the operating end 12*a* of the valve element 12, thus preventing any involuntary operation of the valve element 12 that could cause an unintended expulsion of the pellet 9*a* located in the chamber. Inside the stock zone 7 (see FIG. 2) is a stop 32, which makes contact with the sliding protector 30 and holds it in a retired position against the force of said spring 31 when the casing 27 is installed in the stock zone 7. A retainer 33, which is of a known type, is arranged in the support casing 26 (see FIG. 1) so that it can be operated from the exterior in order to retain the casing 27 in the stock zone 7 against the force of the spring 31. When said retainer 33 is freed in order to extract the casing 27, the sliding protector 30 acts as an expulsion mechanism in virtue of the force provided by the spring 31.

Casing 27 also comprises a lower cover 34 articulated with respect to a shaft 36 and fitted with an elastic lock catch 37. Said lower cover 34 defines an interior cavity for housing and protecting, when in a closed position, a lock wing nut 38 for the pressurised gas cylinder 10. As can be better appreciated in FIGS. 1 and 2, the lower cover 34 defines an exterior surface that extends and ends below an exterior surface of said hollow casing 26 in the stock zone 7, when the casing 27 is installed in the stock zone 7.

One skilled in the art could introduce modifications or variants without leaving the scope of this invention as defined in the included claims.

The invention claimed is:

1. A compressed gas operated pistol, comprising:

a barrel zone, wherein a barrel disposed within the barrel zone is positioned with a rear end of the barrel facing a firing chamber of the pistol;

a trigger zone, comprising a trigger linked to a hammer;

a sliding cover provided in an upper section of the barrel zone and coupled to the trigger,wherein the trigger comprises:

a trigger piece provided in the trigger zone and configured to slide in a linear direction parallel to the barrel;

a plurality of drag snugs extending from the trigger piece, wherein a plurality of stops formed on an inner portion of the sliding cover are configured to receive the plurality of drag snugs, thus causing the sliding cover to be dragged when the plurality of drag snugs are engaged with the plurality of stops and the trigger piece is moved; and a cavity configured to receive a catch fixed to the barrel and to drag the barrel when the catch is engaged in the cavity;

a connection mechanism configured to connect a rear end of the sliding cover to the hammer, wherein the sliding cover is configured to move backwards in a direction parallel to the barrel when the trigger is pressed so as to activate the hammer;

a stock zone, wherein the stock zone comprises:

an ammunition magazine configured to insert and retain a pellet in the firing chamber prior to a shot;

a pressurized gas cylinder configured to connect to a valve chamber; and a valve element configured to connect the valve chamber and the firing chamber, wherein the valve element is configured to be moved from a closed position to an open position by an impact of the hammer; and a sealing device configured to isolate the firing chamber with respect to the ammunition magazine, wherein a catch portion is configured to link the trigger and the barrel, and wherein the trigger is linked to an elastic element provided in a forward portion of the trigger such that, when the trigger is pressed against the force of the elastic element, the barrel is moved rearward in an axial direction to activate the sealing device.

2. The pistol of claim 1, wherein the sealing device comprises:

a cylindrical wall provided at a rear portion of the barrel, wherein an interior surface of the cylindrical wall is configured to define a continuation portion of the barrel, and an exterior surface of the cylindrical wall is configured to fit within an interior surface of the firing chamber; and a final perimeter edge formed at a rear edge of the cylindrical wall and configured to be supported against a rear surface of the firing chamber when the barrel is fully inserted into the firing chamber so as to surround a compressed gas inlet, wherein the cylindrical wall and the final perimeter edge are configured to contain compressed gas provided by the pressurized gas cylinder within the firing chamber.

3. The pistol of claim 2, wherein the exterior surface of the cylindrical wall is configured to prevent the compressed gas in the firing chamber from passing into the ammunition magazine through an opening of the ammunition magazine.

4. The pistol of claim 2, wherein the cylindrical wall is configured to collect a pellet positioned in the firing chamber and to place the pellet in a firing position as the barrel is moved backwards through the activation of the trigger and the final perimeter edge contacts the rear surface of the firing chamber.

5. The pistol of claim 4, wherein the pellet is released from the firing chamber when the sealing device is fully engaged.

6. The pistol of claim 1, wherein the ammunition magazine comprises:

an ammunition store connected to the firing chamber through an opening in an upper portion of the ammunition magazine, wherein the ammunition store is configured to accommodate a plurality of pellets arranged in a column;

an ammunition push mechanism positioned at a lower end of the ammunition store and configured to push the column of pellets towards the opening in the upper portion of the ammunition magazine; and an ammunition release mechanism configured to release a pellet from the column of pellets into the firing chamber.

7. The pistol of claim 6, wherein the ammunition push mechanism comprises a push member in communication with a spring provided at a lower end of the column of pellets.

8. The pistol of claim 6, wherein the ammunition release mechanism comprises a trap rotatably coupled to a shaft positioned at the opening in the upper portion of the ammunition magazine, wherein the trap is configured to be pushed upwards by an adjacent pellet in the column of pellets so as to release a pellet into the firing chamber, and to be pushed downwards by the sealing device as it passes over the trap so as to trap a remaining plurality of pellets in the ammunition store.

9. The pistol of claim 1, wherein the connection mechanism comprises:

a protuberance provided on the hammer; and a pawl provided at a rear end of the sliding cover and configured to engage with the protuberance, and to disengage from the protuberance upon a backwards movement of the sliding cover so as to cause the hammer to produce an impact on the valve element.

10. The pistol of claim 1, further comprising a safety catch connected to the trigger, wherein the safety catch is configured to interfere with a stop provided at an inner portion of the sliding cover when the trigger is at a rest position so as to prevent a movement of the sliding cover independent of a movement of the trigger, and to permit movement of the sliding cover when the trigger is pressed.

11. The pistol of claim 10, further comprising an arm pivotably mounted on a casing of the pistol, wherein the safety catch is configured to be connected to the arm, and wherein the arm comprises a linear guide configured to slide along a snug provided on the trigger so as to cause a downward movement of the safety catch when the trigger is pressed.

12. The pistol of claim 1, wherein the cavity comprises a pair of contact walls with a space formed therebetween configured to receive the catch, and wherein a distance between the contact walls is greater than a width of the catch so as to provide a delay in barrel movement with respect to trigger movement.

13. The pistol of claim 1, further comprising a voluntary safety element mounted on an upper exterior portion of the stock zone, comprising:

a recess formed on a rear portion of the sliding cover; and a tooth configured to fit into the recess when the voluntary safety element is engaged, and to remain in a position outside of the recess when the voluntary safety element is disengaged.

14. The pistol of claim 1, wherein the stock zone further comprises:

a hollow support casing which is open at a lower end and configured to receive a casing, wherein the casing is configured to house the ammunition magazine and a cavity configured to receive the pressurized gas cylinder therein;

a needle configured to perforate a gas outlet portion of the pressurized gas cylinder;

a valve body configured to receive the valve chamber and valve element; and a sliding protector configured to cover an end of the valve element when the casing is removed from the stock zone.

15. The pistol of claim 14, wherein the sliding protector is configured to slide into a protection position through the action of a spring provided in the stock zone, and to be held in the protection position by a stop provided in an upper portion of the stock zone so as to retain the casing in the stock zone through the activation of a retainer provided on the hollow support casing, and wherein the sliding protector is configured to eject the casing from the stock zone when the retainer is deactivated.

16. The pistol of claim 14, wherein the casing comprises:

a cover pivotably coupled to the open lower end of the casing and configured to pivot between an open and a closed position, comprising an interior cavity configured to protect a fastener of the compressed gas cylinder in the closed position; and a lock positioned at the open lower end of the casing and configured to secure the cover to the open lower end of the casing in the closed position.

17. The pistol of claim 16, wherein the cover is configured to define an exterior surface of the casing when the cover is in the closed position.

18. The pistol of claim 1, further comprising a plurality of longitudinal channels formed on sides of the barrel zone and configured to receive a plurality of accessories.

19. A compressed gas operated pistol, comprising:

a firing chamber;

a barrel positioned with a rear end facing the firing chamber and configured to be partially inserted into the firing chamber;

a trigger, comprising a trigger piece linked to a hammer;

a sliding cover positioned proximate to the barrel and coupled to the trigger, wherein the sliding cover is configured to move backwards in a direction parallel to the barrel when the trigger is pressed so as to activate the hammer;

an ammunition magazine configured to insert and retain a pellet in the firing chamber prior to firing of the pistol;

a pressurized gas cylinder configured to provide pressurized gas to the firing chamber through a valve element;

a sealing device configured to contain the pressurized gas provided by the pressurized gas cylinder within the firing chamber, wherein the sealing device comprises:

a cylindrical wall formed extended from a rear portion of the barrel; and a perimeter edge formed at a rear edge of the cylindrical wall, wherein an interior surface of the cylindrical wall is configured to define a continuation portion of the barrel, and an outer surface of the cylindrical wall is configured to fit within an interior surface of the firing chamber, and wherein the perimeter edge is configured to be supported against a rear surface of the firing chamber when the barrel is fully inserted into the firing chamber and to surround an inlet formed in the firing chamber configured to allow pressurized gas to flow into the firing chamber from the pressurized gas cylinder; and a stock zone comprising:

a hollow support casing which is open at a lower end and configured to receive a casing, wherein the casing is configured to house the ammunition magazine and a cavity configured to receive the pressurized gas cylinder therein, and wherein the casing includes a cover pivotably coupled to the open lower end of the casing and configured to pivot between an open and a closed position, comprising an interior cavity configured to protect a fastener of the compressed gas cylinder in the closed position, and a lock positioned at the open lower end of the casing and configured to secure the cover to the open lower end of the casing in the closed position;

a needle configured to perforate a gas outlet portion of the pressurized gas cylinder;

a valve body configured to receive the valve element; and a sliding protector configured to cover an end of the valve element when the casing is removed from the stock zone.

20. The pistol of claim 19, wherein a sealing action of the sealing device is initiated when the trigger is pressed.

21. The pistol of claim 19, wherein the cylindrical wall is configured to collect a pellet positioned in the firing chamber and to place the pellet in a firing position within the firing chamber as the barrel is moved backwards through an activation of the trigger and the perimeter edge contracts the rear surface of the firing chamber.

22. The pistol of claim 19, wherein the cylindrical wall and the perimeter edge are configured to prevent the compressed gas in the firing chamber from leaking out of the firing chamber through and opening in the ammunition magazine.

23. The pistol of claim 19, wherein the pellet is released from the firing chamber when the sealing device is fully engaged.

24. The pistol of claim 19, wherein the ammunition magazine comprises:

an ammunition store configured to receive a plurality of pellets arranged in a column, wherein the ammunition store is connected to the firing chamber through an opening in an upper portion of the ammunition magazine;

an ammunition push mechanism positioned at an end of the column of pellets and configured to push the column of pellets towards the opening in the upper portion of the ammunition magazine, comprising a spring provided at a lower end of the column of pellets; and an ammunition release mechanism configured to release a pellet from the column of pellets into the firing chamber through the opening in the upper portion of the ammunition magazine.

25. The pistol of claim 24, wherein the ammunition release mechanism comprises a trap rotatably coupled to a shaft positioned at the opening in the upper portion of the ammunition magazine, wherein the trap is configured to be pushed upwards by an adjacent pellet in the column of pellets so as to release an uppermost pellet in the column of pellets from the ammunition store into the firing chamber, and to be pushed downwards by the sealing device as it passes over the trap so as to trap a remaining plurality of pellets in the ammunition store.

26. A compressed gas operated pistol, comprising:

a barrel zone, wherein a barrel disposed within the barrel zone is positioned with a rear end of the barrel facing a firing chamber of the pistol;

a trigger zone, comprising a trigger linked to a hammer;

a stock zone, wherein the stock zone comprises:

an ammunition magazine configured to insert and retain a pellet in the firing chamber prior to a shot;

a pressurized gas cylinder configured to connect to a valve chamber; and a valve element configured to connect the valve chamber and the firing chamber, wherein the valve element is configured to be moved from a closed position to an open position by an impact of the hammer;

a sealing device configured to isolate the firing chamber with respect to the ammunition magazine, the pistol further comprising:

a sliding cover provided in an upper section of the barrel zone and coupled to the trigger; and a connection mechanism configured to connect a rear end of the sliding cover to the hammer, wherein the sliding cover is configured to move backwards in a direction parallel to the barrel when the trigger is pressed so as to activate the hammer;

a safety catch connected to the trigger, wherein the safety catch is configured to interfere with a stop provided at an inner portion of the sliding cover when the trigger is at a rest position so as to prevent a movement of the sliding cover independent of a movement of the trigger, and to permit movement of the sliding cover when the trigger is pressed; and an arm pivotably mounted on a casing of the pistol, wherein the safety catch is configured to be connected to the arm, and wherein the arm comprises a linear guide configured to slide along a snug provided on the trigger so as to cause a downward movement of the safety catch when the trigger is pressed.

* * * * *